United States Patent [19]

Ngo

[11] 4,097,780

[45] Jun. 27, 1978

[54] METHOD AND APPARATUS FOR ENERGIZING THE CELLS OF A PLASMA DISPLAY PANEL TO SELECTED BRIGHTNESS LEVELS

[75] Inventor: Peter Dinh-Tuan Ngo, Colts Neck, N.J.

[73] Assignee: Bell Telephone Laboratories, Incorporated, Murray Hill, N.J.

[21] Appl. No.: 715,161

[22] Filed: Aug. 17, 1976

[51] Int. Cl.[2] ..... H05B 41/24

[52] U.S. Cl. ..... 315/169 TV; 340/324 M

[58] Field of Search ..... 315/169 R, 169 TV; 340/324 M, 166 EL, 173 PL

[56] References Cited

U.S. PATENT DOCUMENTS

| | | | |
|---|---|---|---|
| 3,629,653 | 12/1971 | Irwin | 315/169 TV |
| 3,654,388 | 4/1972 | Slottow et al. | 315/169 TV |
| 3,778,673 | 12/1973 | Eisenberg et al. | 315/169 |
| 3,876,906 | 4/1975 | Walters | 315/169 TV |
| 4,002,828 | 1/1977 | Nolan | 315/169 TV |
| 4,021,607 | 5/1977 | Amano | 315/169 TV |
| 4,030,091 | 6/1977 | Ngo | 340/324 M |

*Primary Examiner*—Maynard R. Wilbur
*Assistant Examiner*—Lawrence Goodwin
*Attorney, Agent, or Firm*—Ronald D. Slusky

[57] ABSTRACT

Write pulses are applied to the cells of a plasma display panel to repetitively establish the cells in respective temporary ON states in which the wall voltage stored at each cell decays with each applied sustain pulse. The average number of sustain cycles over which a particular cell remains in the temporary ON state, and thus its perceived brightness, is controlled by controlling the intra-sustain-cycle time occurrence of the write pulses applied thereto.

19 Claims, 8 Drawing Figures

NORMAL SUSTAIN

METHOD AND APPARATUS FOR ENERGIZING THE CELLS OF A PLASMA DISPLAY PANEL TO SELECTED BRIGHTNESS LEVELS

BACKGROUND OF THE INVENTION

My invention is directed to improved plasma panels and, in particular, a method and apparatus for concurrently energizing the cells of a plasma display panel to different brightness levels.

A plasma panel is a display device which includes a body of ionizable display gas sealed between two insulating surfaces, or substrates, such as a pair of glass plates. In a typical "matrix" display plasma panel, a set of parallel "row" conductors are disposed on the inside surface of one substrate, while a set of "column" conductors, orthogonal to the first set, are disposed on the inside surface of the other substrate. A thin layer of a dielectric covers the inside surface of each substrate and the conductors thereon, thereby insulating the conductors from physical contact with the display gas. The individual regions of the panel defined by the overlappings, or crosspoints, of the various row and column conductors function as its display sites, or cells.

Information is displayed on a plasma panel by creating individual glow discharges in the gas at selected crosspoints under the control, for example, of a digital computer. In particular, the computer initiates a discharge at a selected cell by impressing, or applying, a "write" pulse thereacross via its row and column conductor pair. The magnitude of the write pulse exceeds the breakdown voltage of the gas, and a space charge, or plasma, of electrons and positive ions is created in the crosspoint region. Concomitant avalanche multiplication creates a glow discharge and an accompanying short, e.g., one microsecond, light pulse in the visible spectrum. The write pulse, which continues to be applied to the cell, begins to pull the space charge electrons and ions, or charge carriers, to opposite cell walls, i.e., the opposing dielectric surfaces in the crosspoint region. When the write pulse terminates, a "wall" voltage resulting from these so-called wall charges remains stored across the gas at the crosspoint.

A single short-duration light pulse cannot, of course, be detected by the human eye. In order to provide a plasma display cell with the appearance of being continuously light-emitting (ON, energized), further rapidly successive light pulses are needed. These are generated by a "sustain" signal which is impressed across each cell of the panel. The sustain signal may comprise, for example, a train of alternating-polarity pulses. The magnitude of these sustain pulses is less than the gas breakdown voltage. Thus, the voltage across cells not previously energized by a write pulse is insufficient to cause a discharge and those cells remain in non-light-emitting states.

The voltage across the gas of a cell which has received a write pulse, however, comprises the superposition of the sustain signal voltage with the wall voltage previously stored at that cell. The sustain pulse which follows a write pulse has a polarity opposite thereto so that the wall and sustain voltages combine additively across the gas. The combined voltage exceeds the gas breakdown voltage and, a second glow discharge and accompanying light pulse are created. The flow of carriers to the cell walls now establishes an opposite wall voltage polarity. The polarity of the next sustain pulse is also opposite to that of its predecessor, creating yet another discharge, and so forth. After several sustain cycles, the magnitude of the wall voltage is established at a nominally constant, characteristic level which is a function of the gas composition, panel geometry, sustain voltage level, and other parameters. The sustain signal frequency may be on the order of 50 kHz so that the light pulses emitted by an ON cell in response to the sustain signal are fused by the eye of the viewer, and the cell appears to be continuously energized.

A cell which has been established in a light-emitting state is switched to a non-light-emitting (OFF, de-energized) state via the application of an "erase" pulse thereto, which removes the stored wall charge.

Text, graphs, line drawings and other bi-intensity, or bi-level, visual data are readily presented on matrix display devices such as plasma panels by selectively energizing particular display cells. It is also desirable for such devices to be able to display continuous-tone, or gray-scale, images which are multilevel, i.e., in which there are numerous gradations of brightness, or light intensity. A continuous-tone image is typically presented on a matrix type display device by energizing each cell of the device to a brightness level corresponding to the light intensity of a spatially corresponding "picture element" in the original image. Unfortunately, this approach cannot be implemented straightforwardly in plasma display systems since a plasma cell can conventionally display only one of two brightness levels, corresponding to its ON and OFF states.

Numerous arrangements are known in the art to overcome this drawback of plasma and other inherently bi-level display devices. For example, it is known that a plasma cell can be energized to reside in a selected one of several different stable ON states each having a different average light intensity output, by using specially shaped and timed write and sustain signals which generate different stable wall voltage waveforms. Alternatively, the brightness of a plasma cell can be varied by repetitively switching the cell betwen its conventional ON and OFF states at a rapid rate. The average number of sustain cycles per unit time over which the cell is in the ON state, and thus emitting light, is varied, thereby varying the perceived brightness of the cell.

A related technique establishes a cell in a "temporary ON" state by reducing the sustain signal voltage to a level for which the wall voltage of the cell will decrease, or decay, with each sustain pulse rather than stabilizing. Write pulses are applied to the cell at fixed intervals, repetitively establishing it in the temporary ON state. A cell is energized to a selected brightness level by selecting a corresponding magnitude for the write pulses applied thereto. This, again, varies the average number of sustain cycles per unit time over which a cell is emitting light, and thus its brightness.

In other arrangements, a plurality of cells, grouped either in a planar cluster or stacked one behind the other, are used as the basic display unit. A particular display unit is energized to a desired brightness level by energizing a corresponding number of its constituent bi-level cells.

Continuous-tone images can also be represented on bi-level display media using so-called pseudo-gray-scale techniques in which each bi-level cell of the display medium has an assigned threshold value chosen in accordance with a predetermined criterion. The light intensity of each picture element from the original continuous-tone image is compared to the threshold value assigned to the corresponding display cell. A cell is switched ON only if its threshold is exceeded. The resultant displayed image is, in actuality, bi-level since each display cell is still either fully energized or fully de-energized. However, different spatial densities of ON cells in various regions of the image give the appearance of different displayed light intensities when the image is viewed from a distance.

Disadvantageously, each of the above and other arrangements has one or more limitations which renders it unattractive from a commercial standpoint. Some, for example, require complex and expensive special-purpose circuitry. Some require nonstandard row and/or column conductor patterns, which may be difficult to manufacture or which may interfere with more conventional modes of panel operation. And those which rely on varying the spatial densities of ON cells may cause an unacceptable reduction of image resolution.

SUMMARY OF THE INVENTION

The principle object of my invention is to provide a simple and inexpensive method and apparatus for energizing a plasma display cell to a desired brightness level.

Another object of my invention is to provide a simple and inexpensive method and apparatus for energizing the cells of a plasma display panel concurrently to different brightness levels.

These and other objects are achieved by utilizing a write pulse to establish a plasma cell in a temporary ON state similar to that described hereinabove. In accordance with the present invention, however, the number of sustain cycles over which the cell is in the temporary ON state, and thus the light output of the cell, is controlled by varying the time period, $\theta$, between the end of a write pulse which initiates the temporary ON state, and the start of the following sustain pulse. This technique is simpler and more inexpensive than varying, for example, the write pulse amplitude, as is done in the prior art.

In accordance with an aspect of the invention, a cell can be prevented from switching into a permanent ON state in response to a write pulse, without changing the sustain signal waveform, by keeping the above-mentioned time period $\theta$ at no less than a value known as the "recovery time." In preferred embodiments of the invention, however, no such restrictions are placed on $\theta$. Rather, a cell is prevented from switching into a permanent ON state by modifying the sustain signal waveforms.

BRIEF DESCRIPTION OF THE DRAWING

The invention may be clearly understood from a consideration of the following detailed description and accompanying drawing in which.

DETAILED DESCRIPTION

Figure 1:
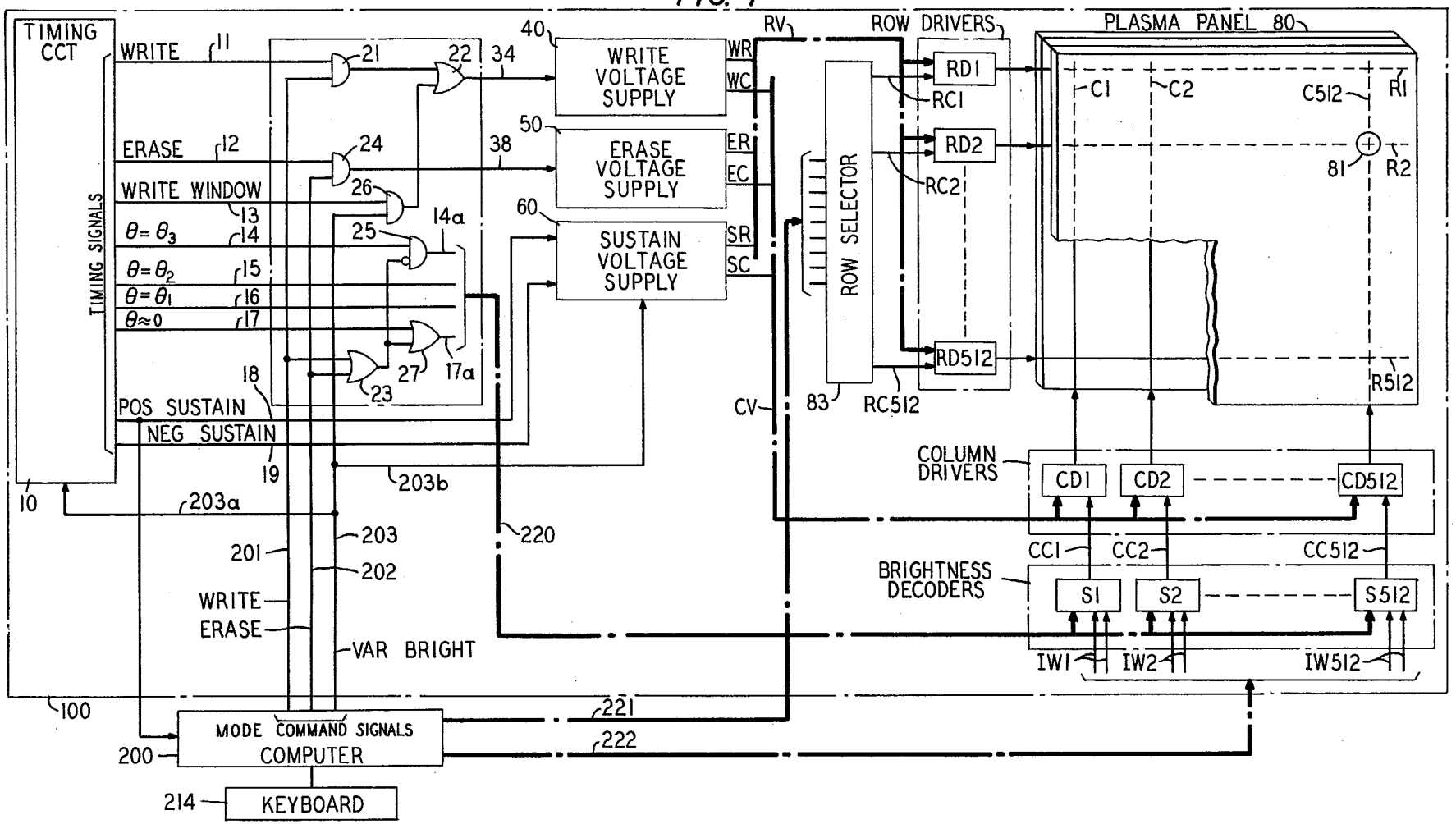
FIG. 1 depicts a display system including a plasma and having circuitry according to the invention for energizing the cells of the panel over a range of brightnesses.

FIG. 1 depicts a display system 100 at the heart of which is plasma panel 80. Panel 80 is comprised of two insulating surfaces, or substrates, such as a pair of glass plates. A continuous body of ionizable display gas is sealed between the plates. A set of 512 "column" conductors C1 through C512 is disposed on the inner surface of one plate in a generally vertical direction. A set of 512 "row" conductors R1 through R512 is disposed on the inner surface of the other plate in a generally horizontal direction. The conductors of each set are spaced very closely together at, for example, 60 per inch. A thin layer of a dielectric such as magnesium oxide covers the inside surface of each plate and the conductors thereon, thereby insulating the conductors from physical contact with the display gas.

The individual regions of panel 80 defined by the overlappings, or crosspoints, of its row and column conductors define a matrix of display sites, or cells. Information is displayed on the panel by creating individual glow discharges in the gas at selected crosspoints, illustratively under the control of digital computer 200. The latter is illustrated as being external to display system 100 in that, typically, the components within system 100 would be manufactured and sold as a package to be connected to the purchaser's own computer or other control system.

Figure 2:
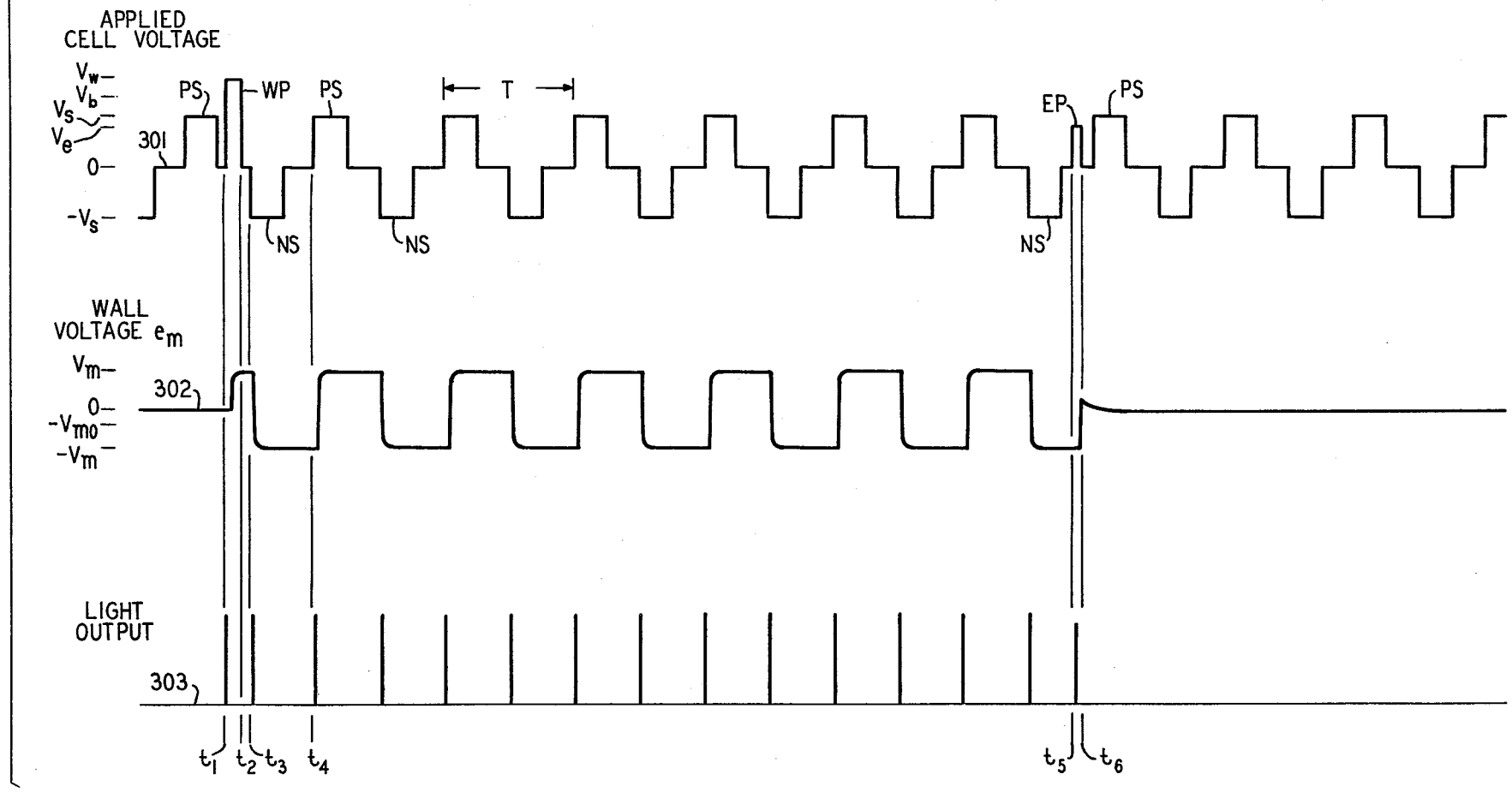
FIG. 2 shows several waveforms helpful in explaining the operation of the display system of FIG. 1 to provide conventional write and erase functions.

As indicated in waveform 301 of FIG. 2, a discharge is initiated at a particular cell of panel 80 such as cell 81 of FIG. 1 by impressing, or applying, a write pulse WP across the cell via its row and column conductor pair R2, C512, such as at time $t_1$. The magnitude $V_w$ of write pulse WP exceeds the breakdown voltage $V_b$ of the display gas in the vicinity of cell 81. A space charge, or plasma, of electrons and positive ions is created in the crosspoint region. Concomitant avalanche multiplication creates a first glow discharge and accompanying short, e.g., one microsecond, light pulse in the visible spectrum. This light pulse, represented for drawing clarity by a narrow spike, is shown in waveform 303 of FIG. 2 as occurring just after time $t_1$. Write pulse WP, which continues to be applied to the cell, begins to pull the space charge electrons and ions, or charge carriers, to opposite cell walls, i.e., the opposing dielectric surfaces in the crosspoint region. When write pulse WP terminates at time $t_2$, a positive "wall" voltage $e_m$ created by these so-called wall charges remains stored across the gas in the crosspoint region, as indicated in waveform 302. This wall voltage plays an important part in the subsequent operation of the panel, as will be seen shortly.

A single short-duration light pulse cannot, of course, be detected by the human eye. In order to provide a plasma display cell with the appearance of being continuously light-emitting (ON, energized), further rapidly-successive light pulses are needed. These are generated by a sustain signal which is impressed across each cell of the panel via its respective conductor pair. As indicated in waveform 301, the sustain signal illustratively comprises a train of alternating positiveand negative-polarity sustain pulses PS and NS, respectively, which repeat every T seconds. The magnitude $V_s$ of these sustain pulses is less than the breakdown voltage $V_b$. Thus, the voltage across cells which have not received a write pulse is insufficient to cause a discharge and those cells remain in non-light-emitting states.

However, the voltage across the gas of a cell which has received a write pulse, such as cell 81, comprises the superposition of the sustain voltage with the wall voltage $e_m$ previously stored at that cell. The sustain pulse which follows write pulse WP, beginning at time $t_3$, is a negative sustain pulse NS so that the wall and sustain voltages combine additively across the display cell gas. The sum of the wall and sustain voltages may be assumed to exceed $V_b$ so that a second glow discharge and accompanying light pulse occur just after time $t_3$. The flow of carriers to the walls of cell 81 now establishes a wall voltage of negative polarity but of magnitude approximately equal to that which previously obtained. Thus, the following, positive sustain pulse beginning at time $t_4$ results in yet another discharge, and so forth. The magitude of wall voltage $e_m$ stabilizes at a nominally constant, characteristic level $V_m$ which is a function of the gas composition, panel geometry, sustain voltage level, and other parameters. The sustain signal frequency may be on the order of 50 kHz; thus, the light pulses of waveform 303 are fused by the eye of the viewer and cell 81 appears to be continuously energized.

Cell 81 is switched back to a non-light-emitting (OFF, de-energized) state by removing its wall charge. This is accomplished by applying an erase pulse EP to the cell such as at time $t_5$, again via conductor pair R2, C512. The magnitude of pulse EP is $V_e > V_b - V_m$. The pulse thus causes a discharge at an ON cell, as the following positive sustain pulse PS would have. Wall voltage $e_m$ begins to reverse polarity. However, erase pulse EP is of such short duration relative to a sustain pulse that the wall voltage reversal is terminated prematurely, at time $t_6$, when the wall voltage magnitude is near zero. No further breakdowns occur and cell 81 is returned to a non-light-emitting state. Any residuum of wall voltage $e_m$ eventually disappears due to recombination of the positive and negative charge carriers and diffusion thereof away from the crosspoint site.

Figure 3:
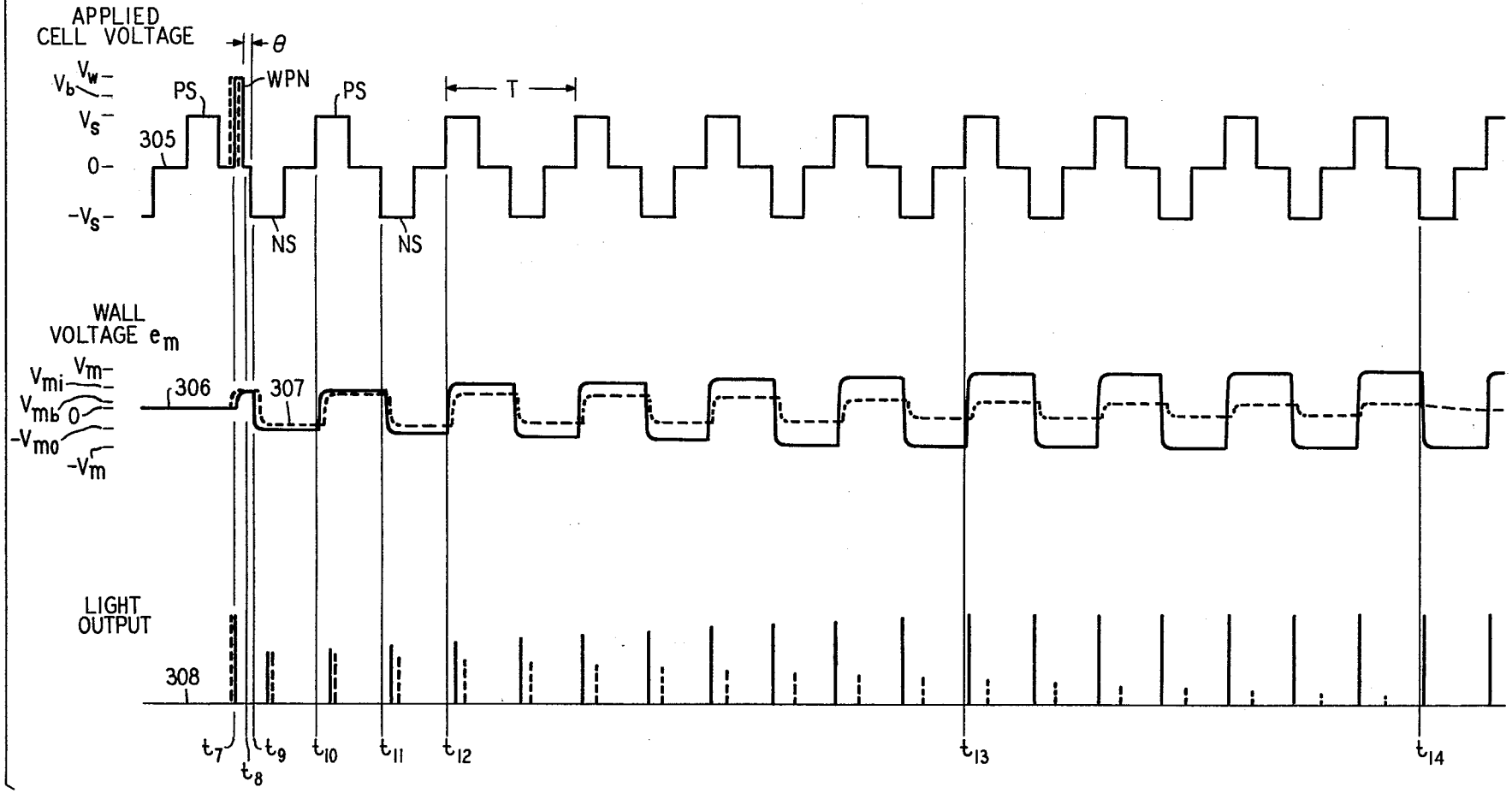
FIG. 3 shows several waveforms illustrating wall voltage build-up and decay in a plasma display cell.

A plasma display cell can also be switched to a light-emitting state by a pulse such as write pulse WPN, which begins at time $t_7$ of waveform 305 of FIG. 3. The magnitude of write pulse WPN is illustratively $V_w$, the same as that of conventional write pulse WP. As indicated by the solid spike occuring in waveform 308, a light pulse occurs just after time $t_7$. The duration of write pulse WPN is less than that of write pulse WP, however. Thus, when pulse WPN terminates at time $t_8$, only a small initial wall voltage $V_{mi}$ has been stored at the cell, as shown in waveform 306. However, it may be assumed that $V_{mi} + V_s > V_b$ so that the negative sustain pulse which begins at time $t_9$ causes a second breakdown.

Wall voltage $e_m$ still does not assume its characteristic level $V_m$ in response to this latest breakdown. This is because the number of space charge carriers created by a breakdown and the time at which breakdown occurs relative to the start of the signal which causes it are both functions of the difference between the breakdown voltage and the magnitude of that signal. (The strength of the emitted light pulse is also a function of that voltage difference.) Illustratively, the combined voltage $V_{mi} + V_s$ impressed across cell 81 at time $t_9$ is not too much larger than $V_b$. As a result, a relatively small space charge is created. Morever, breakdown occurs late in the sustain pulse. (The emitted light pulse is also weak.) Thus, even the relatively small number of space charge carriers which are created by the breakdown are not all pulled to the cell walls by the time the next sustain begins at time $t_{10}$. The value of wall voltage $e_m$ obtaining at time $t_{10}$ may, however, be assumed to exceed a wall voltage turn-on threshold of magnitude $V_{mo}$. This threshold is the minimum wall voltage for which the positive sustain pulse beginning at time $t_{10}$ will create a sufficiently large and timely space charge that the magnitude of the wall voltage obtaining at time $t_{11}$ is greater than that obtaining at time $t_{10}$, leading to an even greater wall voltage at time $t_{12}$, and so forth. After a number of sustain pulses, then, wall voltage $e_m$ builds up to $V_m$, such as at time $t_{13}$ and cell 81 is established in an ON state which is indistinguishable from that which is created by a write pulse WP.

The time interval, or period, $\theta$, which elapses between the end of write pulse WPN and the start of the following sustain pulse is an important factor in the above-described wall voltage build-up process. If $\theta$ is small, a sizable fraction of the space charge carriers created in response to pulse WPN, but not pulled to the cell walls thereby, are still present in the crosspoint region at time $t_9$. The presence of these carriers brings several mechanisms into play, including, for example, a temporarily lowered breakdown voltage at the cell in question. This results in a larger wall voltage at time $t_{10}$ than would obtain if $\theta$ were larger, and reduces the number of sustain cycles required to build up wall voltage $e_m$ to $V_m$. Conversely, if $\theta$ is large, more of the space charge carries created by pulse WPN are allowed to disappear through recombination and diffusion away from the crosspoint region before time $t_9$. This results in a smaller wall voltage at time $t_{10}$ and it takes an increasing number of sustain pulses to build up the wall voltage to $V_m$.

If $\theta$ is made large enough, the wall voltage never reaches $V_m$ and the cell assumes an unstable, "temporary ON" state. Consider write pulse WPN to occur as shown in dashed line in waveform 305. $\theta$ for this pulse now illustratively exceeds a value known as the "recovery time", $\theta_r$ (the magnitude of which varies as a function of the width and magnitude of the write pulse used). As shown by dashed waveform 307, the magnitude of wall voltage $e_m$ at time $t_{10}$, although sufficiently large to cause a breakdown, is less than the abovementioned turn-on threshold $V_{mo}$. The wall voltage and light pulses (dashed spikes in waveform 308) become smaller, rather than larger, with each sustain pulse. Eventually, illustratively at time $t_{14}$, the magnitude of $e_m$ decays to a level below $V_{mb} \equiv V_b - V_s$. No further discharges occur, and the cell returns to a non-light-emitting state. (The difference between $V_{mo}$ and $V_{mb}$ is quite small, but has been exaggerated in FIG. 3 for clarity.)

The total amount of light generated by a cell while in the above-described temporary ON state is a function of both the number of sustain cycles over which discharges occur and the magnitude of the wall voltage which gives rise to each discharge. These quantities, in turn, are dependent on the wall voltage maximum, which obtains at time $t_{10}$. As discussed above, the wall voltage at time $t_{10}$ is, in turn, dependent on $\theta$ (assuming fixed write pulse magnitude and duration). This dependency forms the basis of the present invention.

Figure 4:
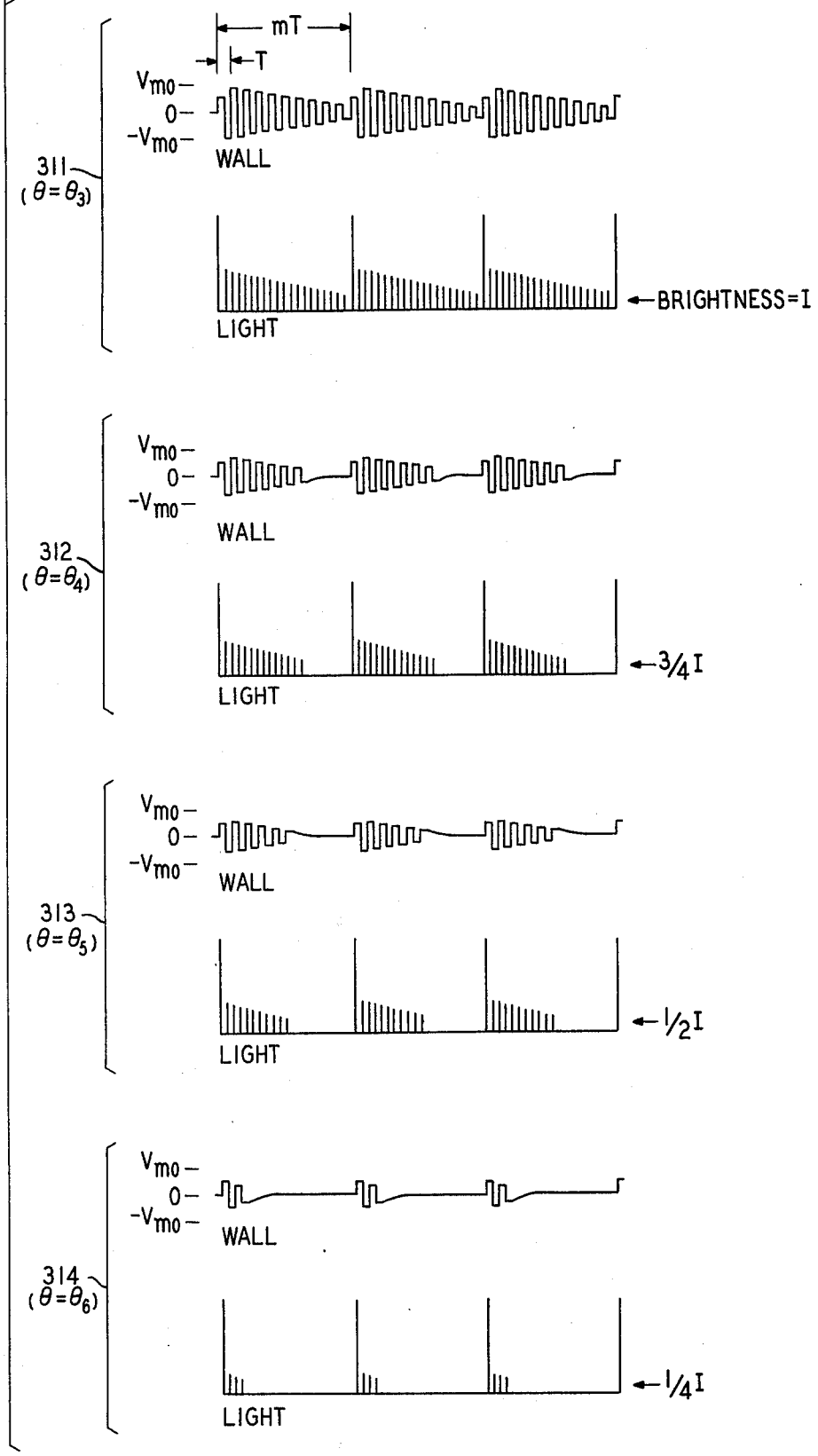
FIGS. 4–6 show several waveforms helpful in explaining the principles of the invention.
Figure 5:
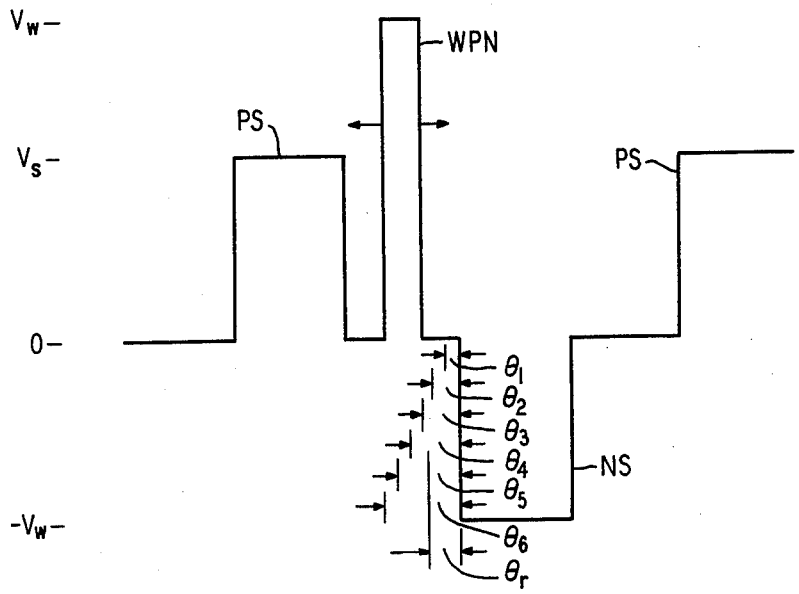

The waveforms of FIG. 4, illustrate the invention in the context of a four-brightness-level display system in which, as has been tacitly assumed throughout the above discussion, a conventional sustain signal is utilized. In particular, waveforms 311 in FIG. 4 show the wall voltage and light output of a cell to which pulses similar to write pulse WPN and having a specific value of $\theta, \theta_3$, are repetitively applied at refresh intervals of duration mT seconds. FIG. 5 shows that $\theta_3$ is just barely larger than the recovery time, $\theta_r$, so that wall voltage $e_m$ is always less than the turn-on threshold $V_{mo}$. For maximum brightness, $m$ is chosen to be no greater than the number of cycles over which discharges will occur in response to a write pulse having $\theta = \theta_3$.

The average intensity, or brightness, of a cell having wall voltage and light waveforms 311 is I. Three other levels of brightness—$(\frac{3}{4})$I, $(\frac{1}{2})$I and $(\frac{1}{4})$I—are provided by repetitively applying to the cell every mT seconds, write pulses having $\theta = \theta_4, \theta_5, \theta_6$, respectively, where, as shown in FIG. 5, $\theta_3 < \theta_4 < \theta_5 < \theta_6$. The wall voltage and light waveforms corresponding to these values of $\theta$ are indicated in FIG. 4 at 312, 313 and 314, respectively.

The technique thus far described for providing a plasma display cell with the ability to display a range of brightnesses, while useful, has its limitations. For example, discharges can be maintained over only a relatively small number of sustain cycles, leading to a high refresh rate requirement. This may be disadvantageous when the display panel has a large number of cells, since it may not be possible to address each cell of a panel within each refresh period. In addition, since the magnitude of the wall voltage $e_m$ cannot be allowed to exceed $V_{mo}$, the displayed image is relatively dim, and gradations in brightness may be difficult to perceive. The overall brightness level of the displayed image could be increased somewhat by shortening the refresh period, but this would worsen the addressing time problem.

Advantageously, the above limitations are overcome in preferred embodiment of the invention in which the sustain signal waveform is modified (in known manner) such that the wall voltage at a cell will decay over a number of sustain cycles, no matter how large the maximum wall voltage magnitude. This may be accomplished by, for example, lowering the sustain voltage level. $\theta$ can now be made as small as desired without the danger that the cell will be switched into a permanent ON state. Accordingly, wall voltage $e_m$ can be made as large as desired; the brightness range is expanded and the refresh time can be increased.

Figure 6:
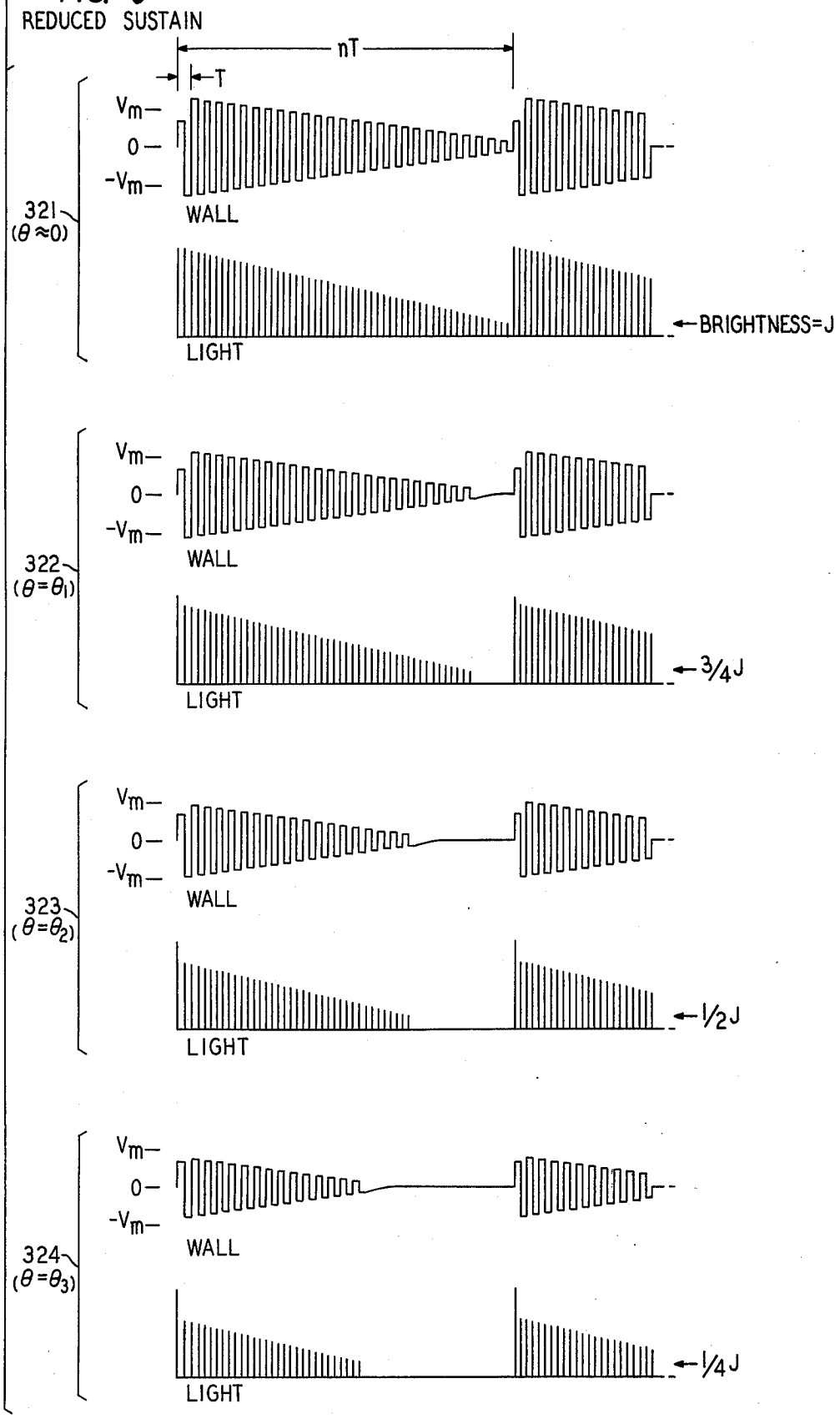

The waveforms of FIG. 6 illustrate this aspect of the invention. The wall voltage and light waveforms indicated at 321 are generated with $\theta \approx 0$. Note that wall voltage $e_m$ is initially large—even larger than $V_m$—thereby substantially increasing the brightness, or average intensity of the light generated by the cell to a magnitude J > I. Moreover, since discharges occur over many more cycles, the refresh period $n$T can be much longer than when a normal sustain signal is used. Wall and light waveforms for $\theta = \theta_1, \theta_2$ and $\theta_3$ where $\theta < \theta_1 < \theta_2 < \theta_3$ (see FIG. 5) are indicated in FIG. 6 at 322, 323 and 324, respectively.

An alternative to reducing the sustain voltage level to ensure wall voltage decay is to reduce the sustain pulse width. This may be a preferably alternative in many applications inasmuch as it allows both the sustain voltage and frequency to be increased over their conventional values while still assuring wall voltage decay. This advantageously provides an even greater brightness range and facilitates even longer refresh periods.

The organization of display system 100 and its operation in conjunction with computer 200 to provide conventional write and erase, and variable brightness functions will now be explained.

Figure 7:
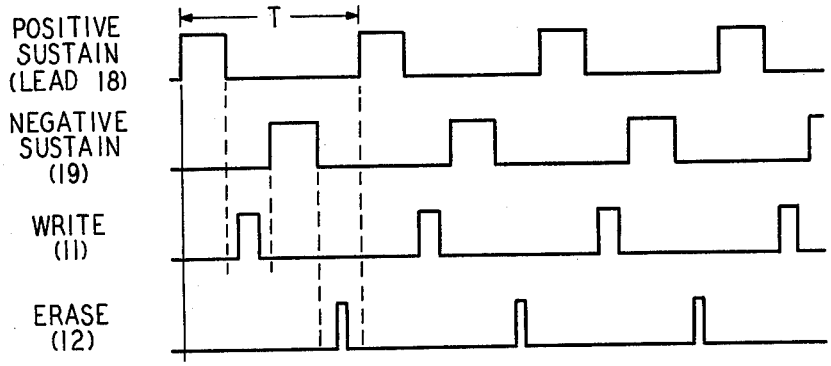
FIGS. 7 and 8 show several timing waveforms generated within the display system of FIG. 1.

Display system 100 includes a timing circuit 10 which controls the sequencing and duration of all signals applied to panel 80. To this end, timing circuit 10 has nine logic level, e.g., 5-volt, output leads 11 through 19. The timing signals on each of these leads defines the initiation and termination point within each sustain cycle of a different type of pulse. For example, as shown in FIG. 7, the timing signals on leads 18 and 19 define the periods within each sustain cycle during which positive and negative sustain pulses, respectively, are to be applied to the cells of the panel. Similarly, the timing signals on leads 11 and 12 define the time periods within each sustain cycle during which conventional write and erase pulses, respectively, are to be applied to the panel. The timing signals on leads 13–17 are discussed hereinafter.

The sustain timing signals on leads 18 and 19 are applied to sustain voltage supply 60. This unit responds to each pulse on positive sustain timing lead 18 to provide a potential $V_s/2$ on row sustain lead SR of cable RV and a potential $-V_s/2$ on column sustain lead SC of cable CV. The potential on lead SR is coupled to each of row conductors R1 through R512 via row drivers RD1, RD2 . . . RD512, while the potential on lead SC is coupled to each of column conductors C1 through C512 via column drivers CD1, CD2 . . . CD512. A positive (row to column conductor) sustain voltage of magnitude $V_s/2-(-V_s/2) = V_s$ is thus impressed across each cell of panel 80. The potentials on leads SR and SC return to zero upon the termination of the pulse on lead 18.

Sustain voltage supply 60 responds to each pulse on negative sustain timing lead 19 to provide the potentials $V_s/2$ and $-V_s/2$ on column and row sustain leads SC and SR, respectively, thereby impressing a voltage $(-V_s/2)-(V_s/2) = -V_s$ across each cell for the duration of the lead 19 timing pulse.

Commands to apply write and erase pulses to a selected cell or cells of panel 80 emanate from computer 200. Computer 200, in turn, may formulate such commands in response to any of several different stimuli. For example, the locations of particular cells and the desired functions, e.g., write or erase, may be generated internally by computer 200 under program control. Alternatively, particular cells to be energized or de-energized may be identified to computer 200 by the user via, for example, keyboard 214 or a light pen (not shown). Or, computer 200 may receive instructions from another, remotely located, computer via a data link.

When, for example, it is desired to apply a write pulse to cell 81 to establish it in an ON state, computer 200 generates a nine-bit code word on row address cable 221 identifying row conductor R2. Responsive to this code word, row selector 83 provides a logic level "1" on row control input lead RC2 of row driver RD2. At the same time, data provided by computer 200 on data cable 222, decoded in a manner described hereinbelow, causes a logic level "1" to be applied to column control input lead CC512 of column driver CD512.

When the next positive transition on positive sustain timing lead 18 indicates to computer 200 that a new sustain cycle has begun, computer 200 provides a pulse at logic level "1" on write command lead 201. This pulse, which will subsist on lead 201 for at least this sustain cycle, is applied to one input of AND gate 21. The other input signal for gate 21 is taken from lead 11. AND gate 21 thus operates in response to the next-occurring write timing pulse on lead 11 to pulse write voltage supply 40 via OR gate 22 and lead 34.

Write voltage supply 40 thereupon provides a potential $V_w/2$ on row write lead WR of cable RV and a potential $-V_w/2$ on column write lead WC of cable CV. Responsive to the "1" on lead RC2, row driver RD2 couples the $V_w/2$ potential on lead WR through to conductor R2. Column driver CD512 similarly responds to the "1" on lead CC512 to couple the $-V_w/2$ potential on lead WC through to conductor C512. The potential across cell 81 is thus $V_w/2-(-V_w/2) = V_w$, i.e., the write pulse magnitude. The signals on leads WR and WC are, of course, necessarily also applied to each other cell in row R2 and column C512, respectively. However, since these two potentials combine only across cell 81, only that cell receives a fullmagnitude write pulse and hence only it is energized. The termination of the write timing signal on lead 11 terminates the pulse on lead 34 and thus the write pulse impressed across cell 81 by supply 40.

When it is desired to apply an erase pulse to cell 81, computer 200 generates an erase command pulse on lead 202, the latter extending to one input of AND gate 24. The next-occurring pulse on erase timing lead 12 operates AND gate 24 to pulse erase voltage supply 50 via lead 38. Supply 50 provides the potentials $V_e/2$ and $-V_e/2$ on leads ER and EC of cables RV and CV, respectively. Responsive to the "1"s on leads RC2 and CC512, drivers RD2 and CD512 couple these potentials to row conductor R2 and column conductor C512, respectively, thereby impressing an erase pulse of magnitude $V_e$ across cell 81. This erase pulse terminates upon the termination of the timing pulse on lead 12.

The operation of panel 80 is explained above in terms of the addressing of a single display cell at a time. However, panel 80 is illustratively arranged to address any number of cells in a selected row concurrently. Computer 200 simply provides data on data cable 222 which places a logic level "1" on each column control lead (CC1, CC2 . . . CC512) associated with a cell to be energized in the selected row. Again, full write or erase voltages, as the case may be, are impressed across only those cells selected to receive them.

When the cells of panel 80 are to be energized to varying brightnesses, in accordance with the invention, computer 200 places a logic level "1" on variable brightness command lead 203. If it were desired, for example, to operate display system 100 in a reduced sustain voltage mode, as previously discussed, the "1" on lead 203 could be used to signal supply 60 to effect an appropriate reduction in the voltage levels on leads SR and SC. Illustratively, however, display system 100 ensures wall voltage decay by reducing the sustain pulse width. As previously noted, this allows the sustain voltage and frequency to be increased, advantageously providing an optimally bright display and facilitating longer refresh periods.

Figure 8:
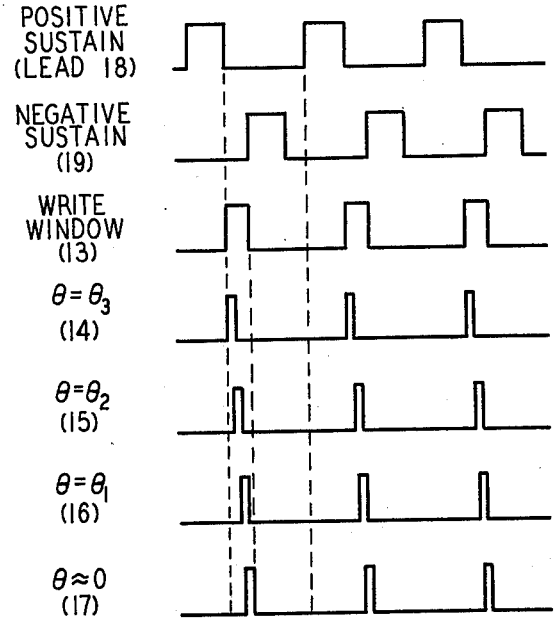

To this end, the "1" on lead 203 is extended to timing circuit 10 via lead **203*a*, in response to which circuit 10 generates on leads 18 and 19 the sustain signal timing waveforms shown in FIG. 8. At the same time, a "1" on lead 203*b* signals supply 60 to increase the voltage levels on leads SR and SC somewhat, providing optimum brightness. As also shown in FIG. 8, timing circuit 10 generates a signal on lead 13 defining a write window between the positive and negative sustain timing periods. Circuit 10 also generates timing signals on leads 14–17** defining precise time slots for write pulses, illustratively similar to pulse WPN, for which $\theta \approx 0$ and $\theta = \theta_1$, $\theta_2$ and $\theta_3$, respectively.

The signal on lead 13 is applied to one input of AND gate 26, enabling gate 26 to pass the timing pulses on lead 13 through to write voltage supply 40 via OR gate 22 and lead 34. Moreover, since leads 201 and 202 are both at logic level "0" at this time, a "0" is provided at the output of OR gate 27. Thus, the timing signals on leads 14 and 17 pass unchanged through AND gate 25 and OR gate 27 to leads **14*a* and 17*a*, respectively. Leads 14*a*, 15, 16 and 17*a* are combined in cable 220**, which extends to brightness decoders S1, S2 . . . S512.

Assume that the first row of cells to be addressed is that defined by row conductor R1. Computer 200 generates an appropriate nine-bit code word on cable 221 to generate a "1" on row control lead RC1 via row selector 83. The potential $V_w/2$, subsisting on lead WR for the entire period defined by the timing pulse on lead 13, is applied to row conductor R1 via driver RD1.

At the same time, computer 200 generates a plurality of two-bit brightness words on lead pairs IW1, IW2 . . . IW512 of data cable 222. The value of each brightness word, viz. 00, 01, 10 or 11, indicates the brightness to which a corresponding cell in the row being addressed is to be energized to display, for example, a continuous-tone image stored in computer 200. The words on lead pairs IW1, IW2 . . . IW512 are applied to individual 1-out-of-4 decoders S1, S2 . . . S512. Each decoder, in turn, responds to its applied brightness word to interconnect an appropriate one of leads **14*a*, 15, 16 and 17*a* of cable 220 to its associated column control lead. Thus, the pulse next appearing on lead 14*a*, for example, is steered to the driver for each column conductor which is to receive a write pulse having $\theta = \theta_3$. The pulse subsequently appearing on lead 15 is steered to the driver for each column conductor which is to receive a write pulse having $\theta = \theta_2$, and so forth. The "1" subsisting throughout this period on lead 34** causes a potential $(-V_w/2)$ to be extended to each column driver via lead WC. Each column driver couples that potential through to its associated conductor for the duration of the signal on its associated control lead, thereby providing write pulse of appropriate $\theta$ to each cell in the row defined by conductor R1.

Computer 200 repeats the above operations for each succeeding row of cells to be addressed, the row being identified on cable 221 and the brightness level for each cell thereof being specified on data cable 222. This process, in turn, is repeated for the entire panel at a predetermined refresh rate.

Finally, it may be noted that when a cell in display system 100 is to be switched from its ON to its OFF state, or vice versa, the "1" on lead 201 or lead 202 is coupled through OR gate 23 to AND gate 25 (where it is first inverted) and to OR gate 27. Leads **14*a* and 17*a* are thereby held at logic levels "0" and "1", respectively. Computer 200** is thus able to place a "0" or a "1" on a selected one of column control leads CC1, CC2 . . . CC512, as previously described, by providing a 00 or a 11, respectively, on the corresponding one of intensity word pairs IW1, IW2 . . . IW512. Write and erase half-select pulses are then able to be applied to selected cells of the panel in the manner previously described.

Although specific arrangements have been shown and described herein, these merely illustrate the principles of the invention. Those skilled in the art will be able to devise numerous other arrangements in accordance with the principles of the invention without departing from the spirit and scope thereof.

What is claimed is:

1. Apparatus for energizing a gas discharge display cell to a desired brightness level comprising sustain means for repetitively impressing alternating-polarity sustain signals across said cell, and means including said sustain means for establishing said cell in a temporary light-emitting state, said establishing means further including write means for impressing at least a first write pulse of non-variable duration across said cell, said write pulse terminating prior to the initiation of a predetermined one of said sustain signals by a selected interval, said write means characterized by means for selecting said interval as a function of said desired brightness level.

2. The invention of claim 1 further comprising means for generating a brightness signal representing said desired brightness level and wherein said selecting means includes means operative in response to said brightness signal for selecting larger values for said interval for smaller desired brightness levels and for selecting smaller values for said interval for larger desired brightness levels.

3. The invention of claim 2 wherein said write pulse and said predetermined sustain signal cooperate to store an initial voltage across said cell and wherein said establishing means comprises means operative in response to each of a plurality of sustain signals which follow said predetermined sustain signal for incrementally decreasing voltages stored across said cell.

4. The invention of claim 3 wherein said write means is further characterized by means for repetitively impressing across a cell write pulses each having said fixed magnitude and each terminating prior to the initiation or respective predetermined ones of said sustain signals by said selected interval to repetitively establish said cell in said temporary light-emitting state.

5. A display system comprising, a display panel including first and second nonconductive surfaces, a continuous layer of gaseous display material disposed between said surfaces, and a plurality of discharge cells each including a respective region of said gaseous display material and each having as walls thereof respective opposing regions of said surfaces, first means for applying at least a first write signal of non-variable duration to at least a selected one of said cells to store a first voltage thereat, second means for repeatedly applying individual sustain signals to each of said cells, said sustain signals being adapted to generate a decaying series of visible light pulses at said selected cell in response to the storage of said first voltage thereat, said first means including means for establishing the average intensity of said light pulses at a predetermined level, said establishing means including third means for establishing the time interval which elapses between the termination of said write signal and the onset of a predetermined one of said sustain signals as a function of said predetermined level.

6. The invention of claim 5 wherein said second means includes means for generating a series of alternating polarity sustain pulses of substantially equal predetermined magnitude, said predetermined magnitude being insufficient to generate a nondecaying series of visible light pulses at a cell.

7. The invention of claim 5 wherein said second means includes means for generating a series of alternating polarity sustain pulses of substantially equal predetermined magnitude but of insufficient duration to generate a nondecaying series of visible light pulses at a cell.

8. The invention of claim 5 further comprising means for generating an intensity signal identifying said predetermined level, said third means comprising means for establishing the duration of said time interval in response to said intensity signal.

9. The invention of claim 8 wherein said first means further includes means for applying to said selected cell a series of write pulses each having a fixed magnitude and said non-variable duration and each terminating prior to the onset of a respective predetermined one of said sustain signals by substantially equal time intervals.

10. The invention of claim 9 wherein said display panel further includes first and second sets of conductors disposed on respective ones of said surfaces, wherein individual overlappings of conductors of said first set with conductors of said second set define locations in said panel of respective ones of said cells, wherein said first means further includes means for applying write signals to an individual cell of said panel by applying respective portions of said write signals to the conductors defining the location of said individual cell and wherein said second means includes means for applying respective portions of said sustain signals to the conductors of said first and second sets.

11. A method for energizing a gas discharge display cell to a desired brightness level comprising the steps of repetitively impressing alternating-polarity sustain signals across said cell, and establishing said cell in a temporary light-emitting state, by impressing at least a first write pulse of non-variable duration across said cell, said write pulse terminating prior to the initiation of a predetermined one of said sustain signals by a selected interval, characterized by the step of selecting said interval as a function of said desired brightness level.

12. The invention of claim 11 wherein in said selecting step larger values are selected for said interval for smaller desired brightness levels and smaller values are selected for said interval for larger desired brightness levels.

13. The invention of claim 12 wherein said write pulse and said predetermined sustain signal cooperate to store an initial voltage across said cell and wherein in said temporary light-emitting state each of a plurality of sustain signals which follow said predetermined sustain signal incrementally decrease the voltage stored across said cell.

14. The invention of claim 13 including the further step of repetitively impressing across said cell further write pulses each having a fixed magnitude and each terminating prior to the initiation of respective predetermined ones of said sustain signals by said selected interval to repetitively establish said cell in said temporary light-emitting state.

15. A method for use in a display system which includes, a display panel including first and second nonconductive surfaces, a continuous layer of gaseous display material disposed between said surfaces, and a plurality of discharge cells each including a respective region of said gaseous display material and each having as walls thereof respective opposing regions of said surfaces, said method comprising the steps of applying at least a first write signal of non-variable duration to at least a selected one of said cells to store a first voltage thereat, repeatedly applying individual sustain signals to each of said cells, said sustain signals being adapted to generate a decaying series of visible light pulses at said selected cell in response to the storage of said first voltage thereat, and establishing the average intensity of said light pulses at a predetermined level by establishing the time interval which elapses between the termination of said write signal and the onset of a predetermined one of said sustain signals as a function of said predetermined level.

16. The invention of claim 15 wherein said sustain signal applying step includes the step of generating a series of alternating polarity sustain pulses of substantially equal predetermined magnitude, said predetermined magnitude being insufficient to generate a nondecaying series of visible light pulses at a cell.

17. The invention of claim 15 wherein said sustain signal applying step includes the step of generating a series of alternating polarity sustain pulses of substantially equal predetermined magnitude but of insufficient duration to generate a nondecaying series of visible light pulses at a cell.

18. The invention of claim 16 comprising the further step of generating an intensity signal indentifying said predetermined level, said establishing step including the step of establishing the duration of said time interval in response to said intensity signal.

19. The invention of claim 18 wherein said write signal applying step includes the step of applying to said selected cell a series of write pulses each having a fixed magnitude and said non-variable duration and each terminating prior to the onset of a respective predetermined one of said sustain signals by substantially equal time intervals.

* * * * *